US007291062B2

(12) United States Patent
Kiss et al.

(10) Patent No.: US 7,291,062 B2
(45) Date of Patent: Nov. 6, 2007

(54) MANUAL POWER GRINDER, IN PARTICULAR A BATTERY-POWERED MANUAL POWER GRINDER

(75) Inventors: Csaba Kiss, Arnot (HU); Istvan Festoe, Miskolc (HU); Szabolcs Molnar, Miskolc (HU)

(73) Assignee: Robert Bosch GmbH, Stuttgart (DE)

( * ) Notice: Subject to any disclaimer, the term of this patent is extended or adjusted under 35 U.S.C. 154(b) by 164 days.

(21) Appl. No.: 11/236,779

(22) Filed: Sep. 27, 2005

(65) Prior Publication Data

US 2006/0068689 A1 Mar. 30, 2006

(30) Foreign Application Priority Data

Sep. 29, 2004 (DE) ..... 10 2004 047 808

(51) Int. Cl.
*B24B 23/04* (2006.01)

(52) U.S. Cl. ..... 451/356; 451/357; 451/488

(58) Field of Classification Search ..... 451/344, 451/354, 356, 357, 456, 488
See application file for complete search history.

(56) References Cited

U.S. PATENT DOCUMENTS 2,597,971 A * 5/1952 Burnham ..... 15/97.1
3,199,251 A * 8/1965 Enders ..... 451/356
3,733,634 A * 5/1973 Golbe ..... 15/28
3,900,974 A * 8/1975 Klebe et al. ..... 451/357
4,242,839 A 1/1981 Armbruster et al.
4,976,173 A * 12/1990 Yang ..... 81/54
5,357,715 A * 10/1994 Hiramatsu ..... 451/357
6,179,696 B1 * 1/2001 Duffy ..... 451/357
6,206,107 B1 * 3/2001 Wadge ..... 173/217
6,846,230 B2 * 1/2005 Jonas ..... 451/359
7,115,018 B1 * 10/2006 Syverson ..... 451/6
2002/0009951 A1 1/2002 Smith et al.

FOREIGN PATENT DOCUMENTS

FR 2 529 497 1/1984

* cited by examiner

*Primary Examiner*—Timothy V. Eley
(74) *Attorney, Agent, or Firm*—Michael J. Striker

(57) ABSTRACT

A manual power grinder has a housing, a motor received in the housing, a grinding disk driven by the motor and located on an underside of the motor, a drive shaft arranged so that the drive shaft and the motor are located parallel to one another and vertically to the grinding disk in the housing and are in rotational communication with one another, and a gear unit providing the rotational communication of the motor and the drive shaft and located in the housing.

18 Claims, 8 Drawing Sheets

MANUAL POWER GRINDER, IN PARTICULAR A BATTERY-POWERED MANUAL POWER GRINDER

CROSS-REFERENCE TO A RELATED APPLICATION

Patent application Ser. No. 11/236,779 was filed, which contains a similar subject matter.

BACKGROUND OF THE INVENTION

The present invention is based on a manual power grinder, in particular a battery-powered manual power grinder.

Battery-powered manual power grinders with usually a plurality of relatively heavy NiCd cells as energy storing means already exist, having the same mechanical components as the manual power grinders corresponding to them that have a mains voltage connection, such as the same gear wheels, fan wheels, and compensation mass for eliminating imbalances, as well as eccentric drives.

A disadvantage of the known hand power tools is their large-volume structural size and their great weight, because they have large, heavy components. This worsens the ergonomics, handiness, and production costs of the known battery-powered manual power grinders.

SUMMARY OF THE INVENTION

It is therefore an object of the present invention to provide a manual power grinder, in particular a battery-powered manual power grinder, which eliminates the disadvantages of the prior art.

In keeping with these objects and with others which will become apparent hereinafter, one feature of the present invention resides, briefly stated, in a manual power grinder, comprising a housing; a motor received in said housing; a grinding disc driven by said motor and located on an underside of said motor; a drive shaft arranged so that said drive shaft and said motor are located parallel to one another and vertically to said grinding disc in said housing and are in rotational communication with one another; and gear means providing the rotational communication of said motor and said drive shaft, said gear means being located below in said housing.

When the manual power grinder, in particular a battery-powered manual power grinder, is designed in accordance with the present invention, it has the advantage that an especially lightweight, handy, compact battery-powered manual power grinder of the shape and size of a travel iron has been created with an especially high power per unit of surface area and per battery charge.

Because of the parallel arrangement of the motor with the motor pinion and the drive shaft with a drive pinion side by side, vertically to the plane of the grinding plate, with the flat sides of the two pinions extending close to and parallel to the grinding plate, the distribution of mass is shifted even closer to the grinding plate, and there is an especially low center of gravity of the hand power tool. Moreover, because of the parallel arrangement of the motor and the drive shaft side by side vertically in the housing, inexpensive, straight-toothed spur gears can be used for force transmission or as a speed-reducing gear with a ratio of approximately i=3 between the motor and the eccentric drive, instead of previous versions that use a toothed belt gear or—in the case of an angled arrangement of the motor relative to the grinding plate—an angle gear.

Because the motor pinion has air guide vanes on one flat side, two functions are united in this compact machine element in a space-saving way. As a result, the motor and the motor pinion can be made especially short, or in other words with a reduced axial length, and the center of mass can be especially low and the housing can be designed as especially low in height. Moreover, compared to the previous construction with a separate engine fan, this kind of separate component can be omitted, and the costs for material and assembly of the battery-powered manual power grinder of the invention are made even more favorable.

Because the gear wheel, on its side toward the motor, is designed as a radial fan with curved air guide vanes, the motor and at the same time the motor pinion, or the drive pinion meshing with it, can be cooled with high efficiency.

Because the drive pinion is designed to fit the motor pinion and as a straight-toothed spur gear meshing with the motor pinion and is located in the lowermost region of the housing, the center of mass of the battery-powered grinder is located lower than was ever attained before.

Because the drive pinion has recesses and accumulations of material on its flat sides, it simultaneously forms an especially compact compensation mass which can moreover be located so that it protrudes axially past the grinding disk bearing toward the grinding disk and hence very close to the grinding disk—and thus is axially short—so that only small imbalancing tilting moments can occur between the grinding disk and the drive shaft, and the compensation mass can be kept small.

Because the drive pinion also has an eccentric peg, in particular integrally with it, it simultaneously forms the most important part of the eccentric drive.

Because the iron-shaped or triangular grinding disk has a grinding plate with a step pointing toward the workpiece in the rear, the height of which step is equivalent to that of a standard Velcro closure, in its tip region it can receive a separate triangular grinding disk that on its underside is flush with the rearward-adjoining remainder of the surface and has a padding layer, which extends flatly and with the same thickness and height toward the padding layer of the region of the grinding disk adjoining it to the rear.

Because at the front, a narrow, elongated grinding tongue can be clipped detachably to the tip of the iron-shaped grinding disk, even the tiniest, narrow workpiece regions can be machined with the battery-powered grinder, so that the range of use of the battery-powered grinder is enlarged.

Because the switch trigger of the battery-powered grinder is a leaf-springlike lever that can be suspended and in particular clamped by its lower end between the housing shells, an especially sturdy, lightweight, inexpensive design of the lever is created.

Since the lithium ion battery has almost no self-discharge, the battery-powered grinder is fully ready for use without restriction even after long intervals between uses; in these intervals, it can rest for an arbitrarily long time on a charging shell in the charging mode, without the battery being impaired thereby. The charging shell can be placed, standing securely, on a level shelf and need not be secured or even grasped firmly when the battery-powered grinder is removed. Because the battery-powered grinder can automatically be put by its charging plug, located on the rear end of the housing, upon placement on the charging shell, into electrical contact with counterpart contacts of the charging shell, and there is no need to pay attention to additional cords or coupling plugs, the power grinder is always ready for fast removal using only one hand; no plug has to be pulled out, and no mounting has to be removed. Moreover, it is automatically assured at all times that the battery-powered grinder is charged.

The compact lithium ion battery, particularly designed as a pair of batteries, sits without play, positionally secured, tensed in the upper region of the grip and is integrated into the strength structure of the grip, and the battery increases the dimensional stability of the grip while using little material for the half shells of the housing.

The novel features which are considered as characteristic for the present invention are set forth in particular in the appended claims the invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
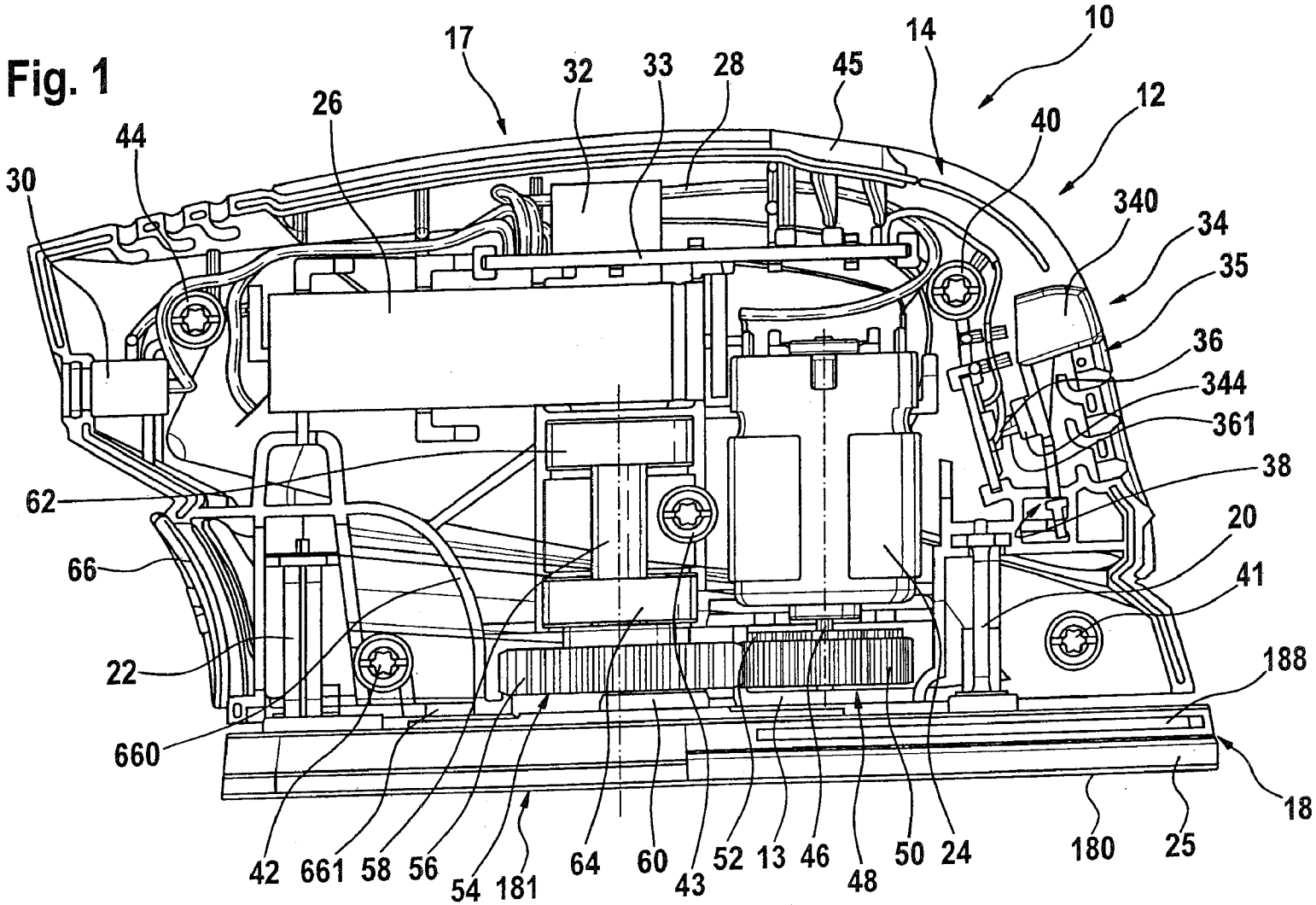
FIG. 1 is a side view of the partly open battery-powered grinder.

FIG. 1 shows an especially small, compact battery-powered grinder 10, whose housing 12 is shown opened, by removal of the right-hand housing shell 16, making it possible to look into the interior of the housing 12, and the parts located in the housing shell 14 and described in further detail below.

The housing 12 is formed of two half-shells 14, 16, which can be put together, braced tightly against one another, in a center plane 15. To that end, five screws extend through bores in the upper half-shell 16 (FIG. 2) in five screw domes 40, 41, 42, 43, 44 of the lower half-shell 14 in order to firmly hold the two against one another. The upper region of the housing 12 forms a curved grip region that can be grasped easily even by small hands.

Beneath it, in the viewing direction, the housing 12 has a triangular grinding disk 18, shaped like an iron for ironing clothes, whose tip 19 points to the right in the viewing direction and defines the recommended feed direction. The grinding disk 18 has a padding layer 25 and is secured in captive form to the housing 12, in particular suspended in it, via two pairs 20, 22 of vibrating bodies, which form four elastic columns screwed to the outer corners of the grinding disk.

A vertically located motor 24 that can be powered by direct current is seated between the grinding disk 18 and the grip region of the housing 12. It can be powered by means of a lithium ion battery 26, or in particular a pair of such batteries placed side by side, and is electrically connected to the battery or batteries via electric cords 28 extending in the interior of the housing 12. Two of the electric cords 28 connect the battery 26, via an electronics unit 32, to a charging plug 30 located at the rear, in the upper region of the housing 12, so that on being connected in plug-in fashion to the mating plug of a charging device that is ready for operation, the battery 26 can easily be charged. The electronics unit 32, with elements for converting alternating current to direct current and for regulating the battery charging operation, is seated on a printed circuit board 33, fixed toward the top in the grip region 17 of the housing 12.

On the right in the viewing direction, there is a switch trigger 34 toward the face end on or in the housing 12; its pushbutton 340 protrudes out of an opening 35 in the housing 12, with flush contours to the outside, where it can easily be reached by the user's hand. Via a key cam 344, the switch trigger 34 can be braced against a switch key 361 of an electric switch 36 for actuation, so that when the pushbutton 340 is pressed inward, the switch 36 can be put in the activation position, and when the pushbutton 340 is let go it can be put in the deactivation position.

The spring-tonguelike switch trigger 34 can be fixed with its lower region, by means of a positioning rib 38, in suitable central recesses in the housing shells 14, 16, so that it is fastened on the order of a toggle switch on the housing 12 and acts resiliently on the switch 36.

A motor shaft 46 emerges from the motor 24 at the bottom, and on it a motor pinion 48 is firmly held in a manner secure against rotation by its central bore 49. On the flat top 47 of the motor pinion 48, ventilator ribs 52 in the form of curved air vanes are distributed at regular intervals, in particular being molded, for instance pressed or cast, so that the motor pinion 48 acts not only as a gear element but also as a ventilator, particularly for cooling the motor. The motor pinion 48 has straight teeth 50, with which it meshes with counterpart teeth 56 of a drive pinion 54. The flat underside 51 of the motor pinion 48 is located directly close to the lower horizontal housing wall 13 and indirectly but still close to the top 78 of the grinding disk 18, at a distance of less than 5 mm.

Regular recesses 53 for reducing the weight are located on the underside 51 of the motor pinion 48 and are spanned by spokelike webs 55, thus lending the motor pinion 48 quite adequate strength. The drive pinion 54 has a larger diameter than the motor pinion 48, so that a ratio of i=2 to 3 is created. The teeth 56 of the drive pinion 54 fit between those of the motor pinion 48. By means of a drive shaft 58, the drive pinion 54 is supported in the housing 12 next to and parallel to the motor 24 via one upper and one lower drive bearing 62, 64. On its underside, the drive pinion 54 has an eccentric element 70 (FIGS. 5, 6, 8), whose eccentric engagement 60 with the grinding disk 18 is effected via a disk bearing 68, so that the rotating drive pinion 54 lends an orbital motion to the grinding disk 18 by means of the eccentric element 70.

To the rear, the housing 12 has a central suction extraction opening 66, through which grinding dust can be vacuumed out by means of the connection of a vacuum cleaner hose, not shown, which is formed on the underside 80 of the grinding disk 18 or of the grinding sheet 77.

Figure 2:
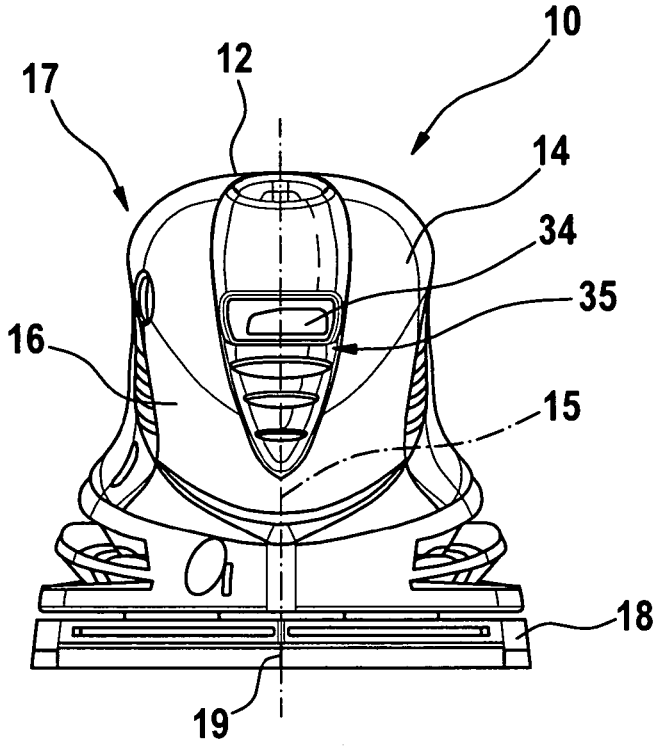
FIG. 2 is a front view of the battery-powered grinder.

FIG. 2 shows a front view of the battery-powered vibrating grinder 10, looking toward the center plane 15 of the motor housing 12, its half-shells 14, 16, the switch trigger 34, a transparent window 45, and the tip 19 of the grinding disk. The grip region 17 is narrower in width than the grinding disk 18. At the top front, the motor housing 12 has the transparent window 45, which is put in place and extends along the parting plane 15 and allows one to look through openings in the half-shells 14, 16 to see colored light-emitting diodes, not shown in detail, that serve particularly to indicate the charge status.

Figure 3:
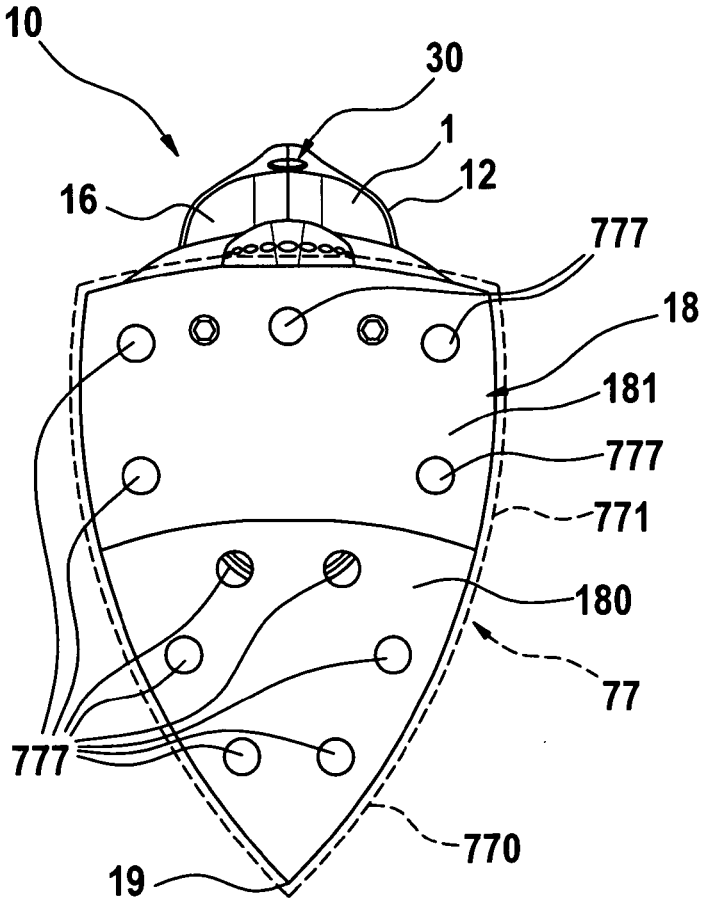
FIG. 3 is a view of the battery-powered grinder from below.

FIG. 3 shows a view from below on the battery-powered vibrating grinder 10 and the underside 80 of the grinding disk 18, or a grinding sheet 77 (FIG. 5) fixed to it by means of a Velcro closure or the like, the outline of the grinding sheet being shown in dashed lines. The iron-shaped contour of the grinding disk 18 and of the grinding sheet 77 can be seen. The grinding disk 18 is composed of a front, removable, equilateral triangular grinding disk 180 and a fixedly disposed remaining grinding sheet 181, which forms a regular trapezoidal differential face that together with the small triangular grinding disk 180 forms the iron shape.

The grinding disk 18 has a hooked layer which corresponds to a velour layer of commercially available grinding sheets and is pierced by round inlet openings 777 for removing grinding dust as well as by four screw holes, not identified by reference numeral, for fastening the vibrating bodies 20, 22.

A corresponding grinding sheet 77 can be put together from a front grinding sheet 770 in the shape of an equilateral triangle and a remaining grinding sheet 771 behind it, optionally offset from one another by a perforated intentional tearing line, and has eleven of the inlet openings 777 for the passage through them of grinding dust that is vacuumed away. The front grinding sheet 770 is equivalent to a standard triangular grinding sheet with curved outer edges for commercially available triangular grinders. The remaining grinding sheet 771 forms a special shape, with two parallel, straight outer edges, one curved front edge, flushly adjoining the curved outer edge of the grinding sheet 770, and one outward-curved rear edge. The remaining grinding sheet 771 enlarges the effective grinding area, so that the removal power of the battery-powered grinder is markedly improved over known triangular grinders with a standard triangular grinding sheet 770.

Figure 4:
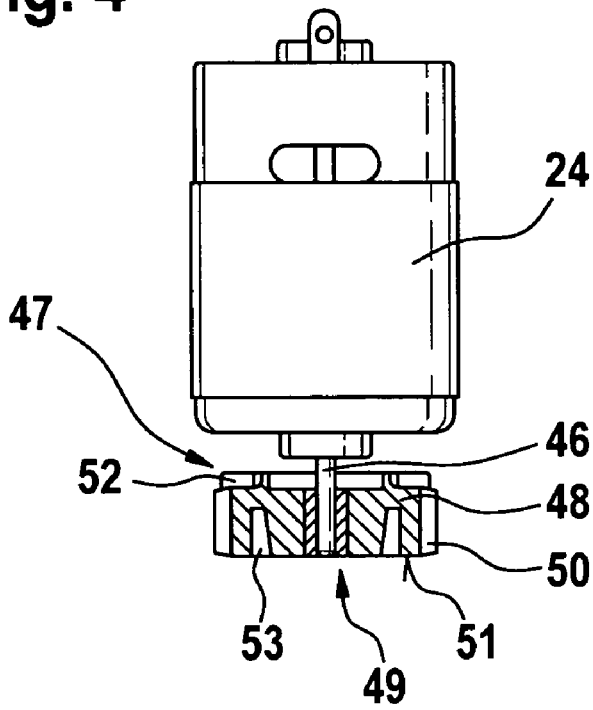
FIG. 4 is a detail showing the motor with the motor pinion from the side.

FIG. 4 shows a side view of the motor 24 in the form of a detail, with the motor shaft 46 and the motor pinion 48 seated on it, with the teeth 50 and the ventilator ribs 52 on its flat top 47. It can be seen that a bush, not identified by reference numeral, is seated in the bore 49 for the sake of engaging the motor shaft 46 in such a way that it is secure against rotation.

Figure 5:
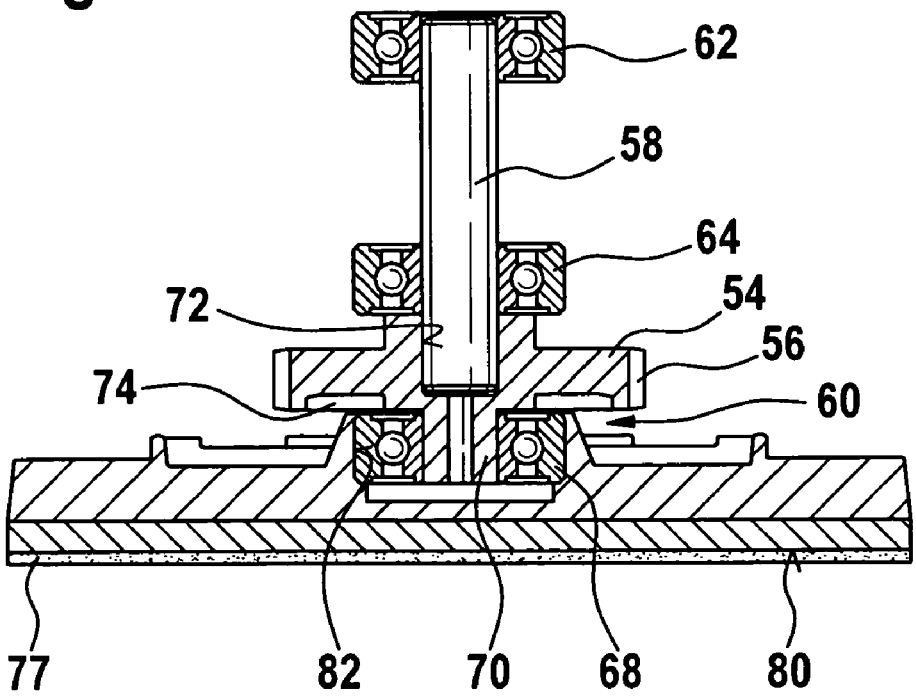
FIG. 5 is a detail showing the eccentric drive with the grinding plate from the side.

FIG. 5 shows a detail of a compact structural group, made up of the grinding disk 18 with the meshing drive pinion 54 and the power takeoff shaft 58. The drive pinion 54, with its eccentric peg 70, engages a disk bearing 68, embodied as a roller bearing. As a result, the rotation of the eccentric peg 70 is transmitted not directly but rather indirectly to the grinding disk 18, imparting an orbital motion to the grinding disk. The disk bearing 68 is seated in a recess, acting as a bearing seat 82, on the top 78 of the grinding disk 18. A grinding sheet 77 is seated on the underside 80 of the grinding disk 18, held there by a Velcro closure. The drive shaft 58, with its lower end, reaches in a manner secured rotation into a central blind bore 72 on the top of the drive pinion 54. It is guided in one upper and one lower drive bearing 62, 64.

Figure 6:
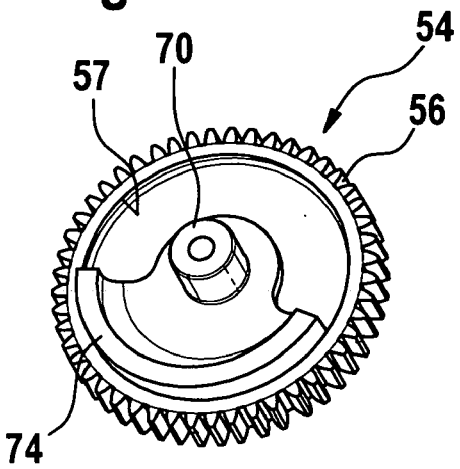
FIG. 6 is a view of the eccentric drive wheel from below.

FIG. 6 shows the underside 57 of the drive pinion 54. Straight teeth 56 are located on the circular circumference of the drive pinion, and the upward-pointing eccentric peg 70 and the compensation mass 74 designed as an annular segment can both be seen.

Figure 7:
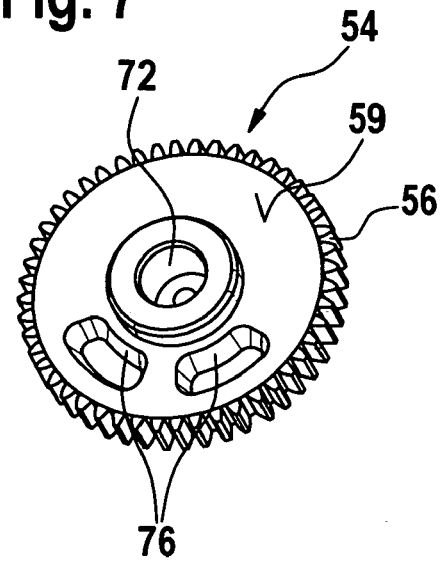
FIG. 7 is a top view on the gear wheel of FIG. 6.

FIG. 7 shows the top 59 of the drive pinion 54 with the central blind bore 72 and the eccentric recesses 76, which—like the compensation mass—also serve to compensate for imbalance.

Figure 8:
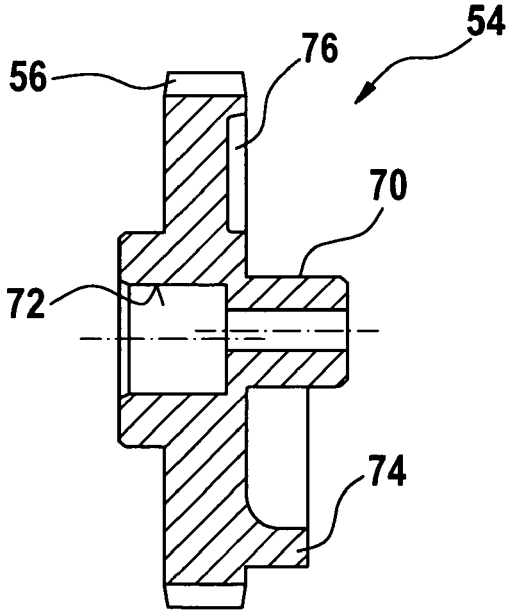
FIG. 8 is a sectional view of the gear wheel of FIGS. 6 and 7.

FIG. 8 shows a longitudinal section through the drive pinion 54, clearly showing its design and its integral nature with the eccentric peg 70, the central blind bore 72, the compensation mass, and the recesses 76.

Figure 9:
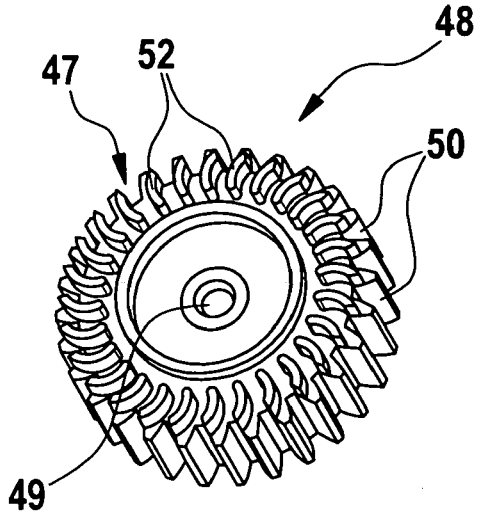
FIG. 9 is a detail showing a top view of the motor pinion.

FIG. 9 shows the top 47 of the motor pinion 48 as a detail. Its central bore 49 for the passage through it of the motor shaft 46 can be clearly seen along with the straight teeth 50 and the ventilator ribs 52.

Figure 10:
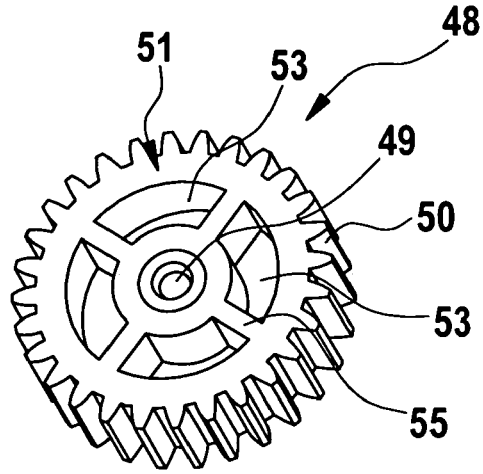
FIG. 10 shows the motor pinion from below.

The underside 51 of the motor pinion shown in FIG. 10, in addition to the characteristics shown in FIG. 9, shows the recesses 53 that serve to reduce weight and the spokelike webs 55 fitting over these recesses.

Figure 11:
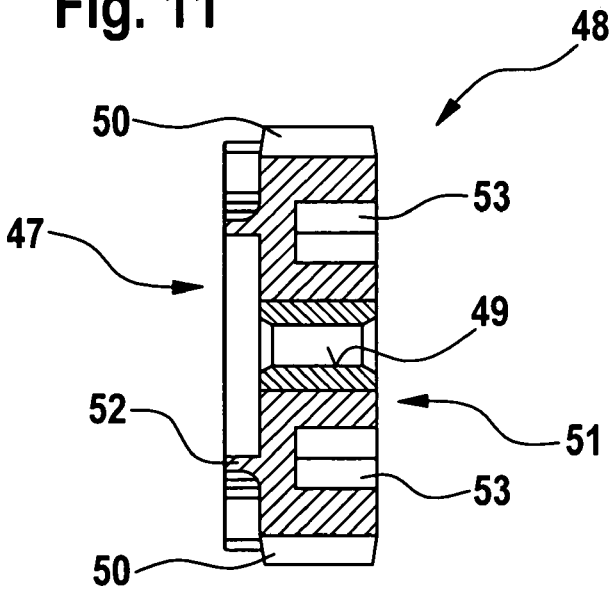
FIG. 11 is a sectional view of the motor pinion.

FIG. 11 shows a longitudinal section through the motor pinion 48, in which the details mentioned in conjunction with FIGS. 9 and 10 are seen especially clearly.

Figure 12:
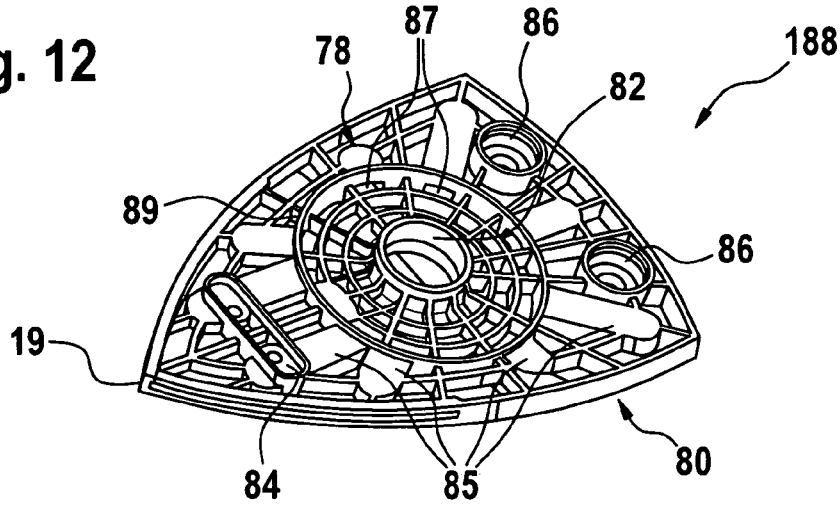
FIG. 12 is a three-dimensional top view on the grinding disk.

FIG. 12 is a three-dimensional view of the grinding plate 188 of the grinding disk 18, looking toward the top 78 thereof. Its triangular shape—like the soleplate of an iron—is clearly shown, as is the fact that—as in an iron—the tip 19 points forward. The seats 84, 86 for retaining the vibrating bodies 20, 22 can be seen clearly; these bodies can be secured to the seats, in particular with a screw or the like that can be screwed in from below. Besides netlike annular and radial ribs 89, or ribs 89 that are parallel to the outer contour, wider radial ribs 85 can be seen, which form the top of dust passage conduits 94 (FIG. 15) that are open at the bottom and whose axial outlet openings 87 are seated on the top 78 of the grinding disk 18 in the outer annular ribs 89. From these, grinding dust that occurs can be removed to the outside through a half-moonshaped inlet opening 661 (FIG. 23) in the lower housing wall 13 of the housing 12, through a conduit (FIGS. 1 and 23), formed by curved housing walls 660, to the suction extraction opening 66. The dust entry takes place on the underside 80 of the grinding disk 18 through eleven inlet openings 777.

Figure 13:
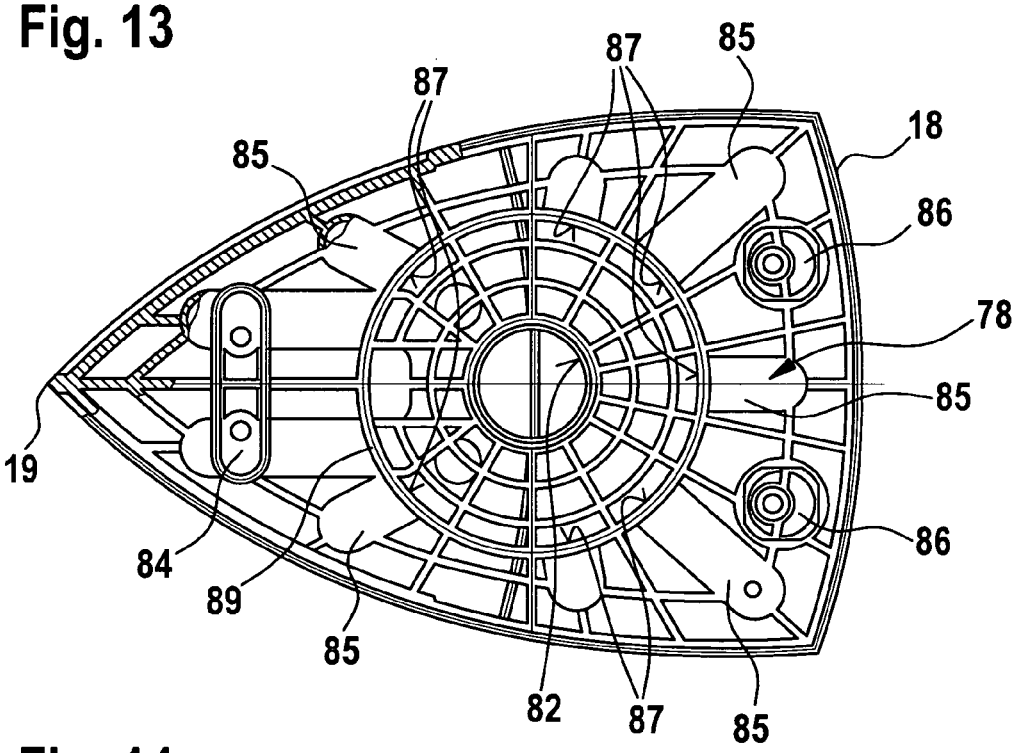
FIG. 13 is a plumb top view on the grinding disk.

FIG. 13, with a plumb top view on the grinding plate 188, shows the details for explaining FIG. 12; the ribs 85 of the suction extraction conduits 83 are more clearly visible than in FIG. 12, as are their axial outlet openings 87 on the inside of the outermost annular rib 89. Suction extraction air flows through them via the through opening 661 in the lower housing wall 13 to the suction extraction opening 66 at the rear end of the battery-powered grinder 10.

Figure 14:
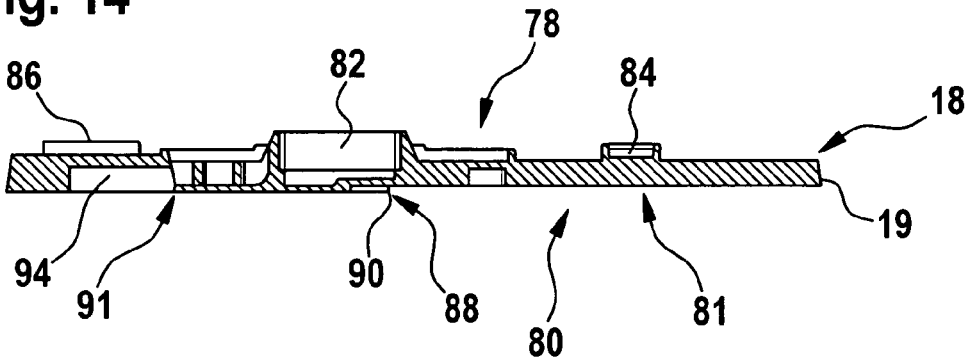
FIG. 14 is a longitudinal section through the grinding disk.

FIG. 14 shows a longitudinal section through a grinding plate 188, whose underside 80 in the front region 81 forms a step 88 toward the top. This step 88 is the same height as the Velcro closure system that for instance comprises one layer of hooks and one layer with loops, by which the triangular grinding disk 180 is detachably secured to the grinding plate 188. As a result, the padding layer 25 of the grinding disks 180, 181 can have a uniform thickness and can extend in a straight line, or level, at the same height over the entire grinding disk 18. The front and rear regions 81, 91 of the grinding plate 188 are offset from one another by a stepped edge 90.

Figure 15:
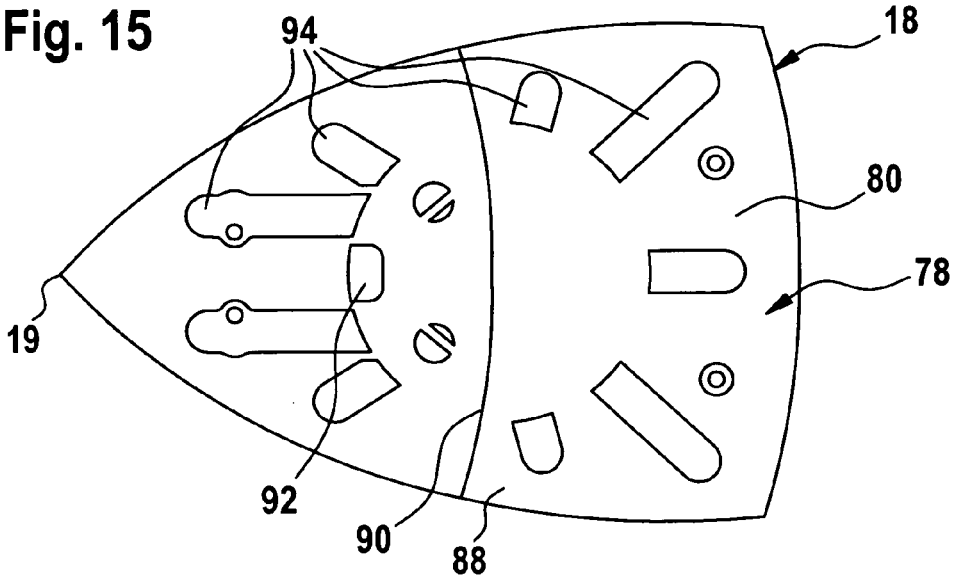
FIG. 15 is a view of the grinding disk from below.

FIG. 15 shows the underside 80 of the grinding plate 188 with the dust passage conduits 94, which form ribs 85 on the top of the grinding plate 188 and end in the suction extraction openings 87. There is also a detent opening 92 for suspending an additional grinding disk, shown as a grinding tongue 1800 (FIG. 16).

Figure 16:
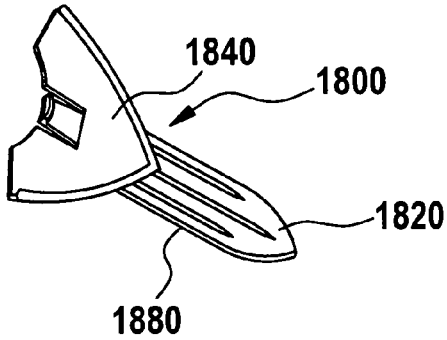
FIG. 16 is a three-dimensional view of a grinding tongue.

FIG. 16 shows the grinding tongue 1800 in a three-dimensional view; its grinding tip 1820, which is both elongated and protrudes toward the front and the coupling face 1840 can be seen clearly; below the underside 1880, a suitably narrow, elongated grinding sheet can be attached.

Figure 17:
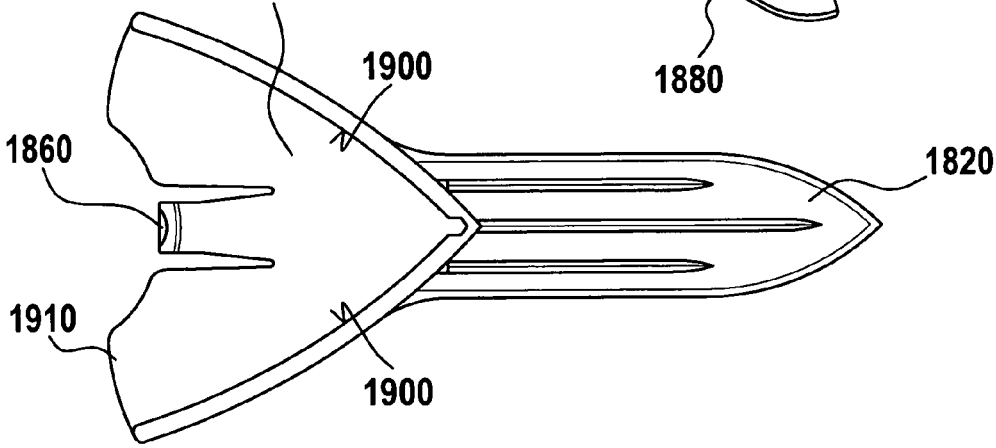
FIG. 17 is a top view on the grinding tongue.

FIG. 17 shows the top view on the grinding tongue 1800; a resilient coupling tongue 1860 is located in the middle of the edge 1910, toward the tool, of the coupling face 1840, and when the grinding tongue 1800 is secured to the grinding plate 188, this face, instead of the triangular grinding disk 180, enters the detent opening 92 and firmly holds the grinding tongue 1800 there. Lateral top edges 1900 on the coupling face 1840 for positioning and retaining the grinding tongue 1800 on the grinding plate 188 assure a play-free, firm coupling connection.

Figure 18:
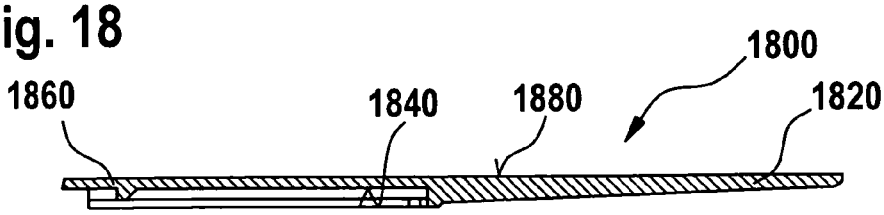
FIG. 18 is a longitudinal section through the grinding tongue.

FIG. 18 shows a longitudinal section through the grinding tongue 18 and shows that its underside 1880 is level and is intended for receiving suitable elongated, narrow grinding sheets.

Figure 19:
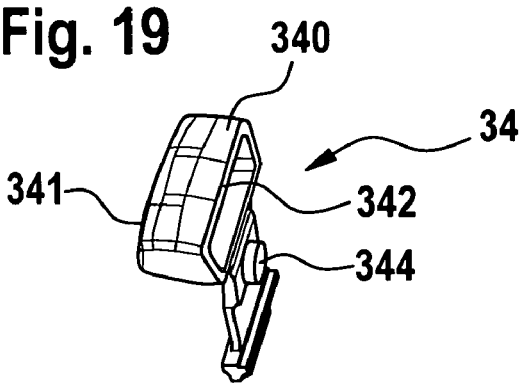
FIG. 19 is a three-dimensional view of the switch trigger.

FIG. 19 shows a three-dimensional detail of the leaf-springlike switch trigger 34. Its shell-shaped pushbutton 340 is located in the upper region and is provided with a face end 341 curved toward the front. This assures easy manipulation. The resilient body of the switch trigger 34 adjoins it toward the bottom, and oblique reinforcing ribs 348 are located in the upper region between the pushbutton 340 and the spring body 343.

The back side 342 of the pushbutton 340 is hollow, because of the shell-like design, and is oriented toward the interior of the housing. The spring body 343, on its back side, has a key cam 344, which serves to enable access to the switch key of the switch 36.

In the lower region, the spring body has a transversely extending pinlike region, which serves as a positioning rib 38 and retains the switch trigger 34 without play, fastened in captive fashion, in suitable recesses in the housing shells 14, 16 of the housing 12.

Figure 20:
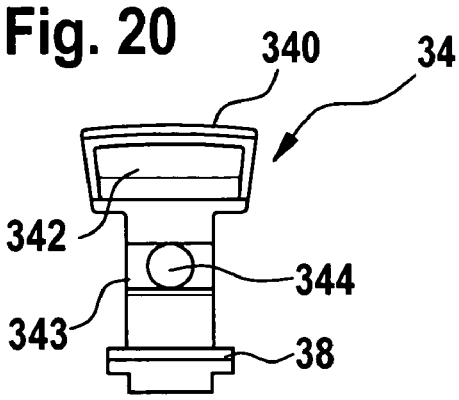
FIG. 20 is a view of the switch trigger from behind.
Figure 21:
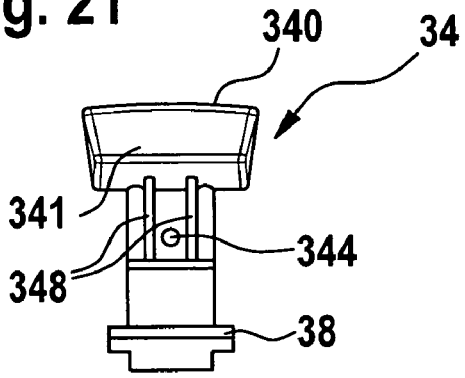
FIG. 21 is a front view of the switch trigger.
Figure 22:
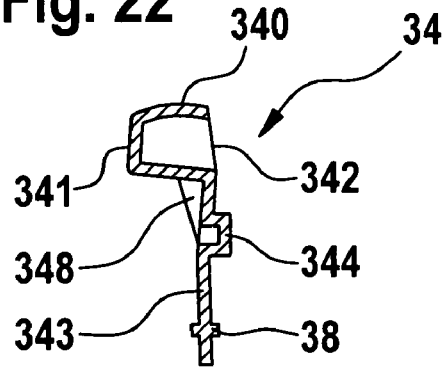
FIG. 22 is a cross section through the switch trigger.

FIGS. 20 through 22 show the switch trigger from behind, from the front, and in longitudinal section, making the explanations of FIG. 19 clearer.

Figure 23:
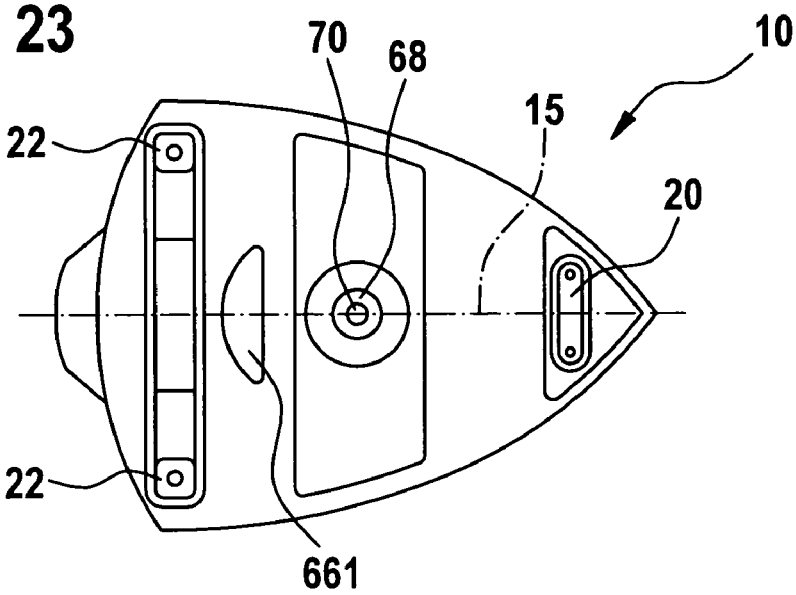
FIG. 23 is a view of the housing from below.

FIG. 23 shows the underside of the battery-powered grinder 10 with the grinding disk removed; the half-moon-shaped inlet opening 661 can be clearly seen centrally to the center plane 15—and both half-shells 14, 16—behind the eccentric peg 79 and the disk bearing 70. The view is also opened up to the underside of the front and rear vibrating bodies 20, 22 that are arranged in pairs.

It will be understood that each of the elements described above, or two or more together, may also find a useful application in other types of constructions differing from the types described above.

While the invention has been illustrated and described as embodied in a manual power grinder, in particular a battery-powered manual power grinder, it is not intended to be limited to the details shown, since various modifications and structural changes may be made without departing in any way from the spirit of the present invention.

Without further analysis, the foregoing will so fully revela the gist of reveal present invention that others can, by applying current knowledge, readily adapt it for various applications without omitting features that, from the standpoint of prior art, fairly constitute essential characteristics of the generic or specific aspects of the invention.

The invention claimed is:

1. A manual power grinder, comprising a housing; a motor received in said housing; a grinding disk driven by said motor and located on an underside of said motor; a drive shaft arranged so that said drive shaft and said motor are located parallel to one another and vertically to said grinding disk in said housing and are in rotational communication with one another; and gear means providing the rotational communication of said motor and said drive shaft, said gear means being located in said housing, wherein the gear means include a straight-toothed pair of gear wheels, formed of two gear wheels, wherein said gear wheels are located, pointing toward said grinding disk, substantially close to said grinding disk in such a way that flat sides of said gear wheels extend substantially parallel to said grinding disk, wherein one of said gear wheels serves as a motor pinion and has a flat top facing toward said motor and provided with air guide means for generating cooling air or suction.

2. A manual power grinder as defined in claim 1, wherein said motor pinion is configured as a radial fan.

3. A manual power grinder as defined in claim 2, wherein the manual power grinder is formed as a battery-powered grinder.

4. A manual power grinder as defined in claim 1, wherein one of said gear wheels is configured as a drive pinion which meshes with said grinding disk and is provided with at least one compensation element selected from the group consisting of a compensation mass, a compensation bore, and both.

5. A manual power grinder as defined in claim 4, wherein said compensation mass and said compensation bore are on diametrically opposed flat sides of said drive pinion.

6. A manual power grinder as defined in claim 4, wherein said compensation mass is configured as an annular segment and is seated on an underside of said drive pinion.

7. A manual power grinder as defined in claim 6, wherein said drive pinion, on a side of said compensation mass, has an eccentric peg which is integral.

8. A manual power grinder as defined in claim 7, wherein said compensation mass is configured as an annular segment extending parallel to said eccentric peg over substantially half of a length of said eccentric peg and concentrically.

9. A manual power grinder as defined in claim 1, wherein said grinding disk has a triangular grinding disk element having a stepped form and a tip provided with a removable equilateral triangular grinding disk member and rear with a grinding sheet that increases a surface area, so that said grinding sheet adjoins the rear of said triangular grinding disk element member.

10. A manual power grinder as defined in claim 9, wherein said grinding sheet has two parallel straight outer sides, one rear side curved outwards and one front side curved inwards.

11. A manual power grinder as defined in claim 9, wherein said triangular grinding disk member and said grinding sheet form a common level surface and have a level uniformly thick padding layer merging flush with one another.

12. A manual power grinder as defined in claim 9, wherein said grinding disk member has eleven radial dust passage conduits passing through said grinding disk member at a shallow length from an outer bottom obliquely upwards and inwards, with dust inlet openings provided on an underside in an annular rib, with outlet openings provided on a top in the annular rib, and with side walls that form ribs on a top of said grinding disk.

13. A manual power grinder as defined in claim 9; and further comprising a narrow, elongated grinding tongue which is detachably clippable at a front to said tip of said triangular grinding disk member.

14. A manual power grinder as defined in claim 1, and further comprising a switch trigger for switching said motor on and off, said switch trigger being configured as a leaf-spring shaped part to be actuated by bending.

15. A manual power grinder as defined in claim 14, wherein said switch trigger has a lower end and is fastenable in captive fashion by said lower end in said housing.

16. A manual power grinder as defined in claim 14, wherein said switch trigger is configured with its upper end as a convexly curved pushbutton.

17. A manual power grinder as defined in claim 1, and further comprising a charging plug which is located on a rear end of said housing, and is contactable in a charging position with counterpart contacts of a charging shell, so that no additional cords or coupling plugs need to be actuated.

18. A manual power grinder, comprising a housing; a motor received in said housing; a grinding disk driven by said motor and located on an underside of said motor; a drive shaft arranged so that said drive shaft and said motor are located parallel to one another and vertically to said grinding disk in said housing and are in rotational communication with one another, and gear means providing the rotational communication of said motor and said drive shaft, said gear means including gear wheels and located in said housing, wherein one of said gear wheels serves as a motor pinion and has a flat top facing toward said motor and provided with air guide means for generating cooling air or suction.

* * * * *